United States Patent [19]

Andrews et al.

[11] 4,200,283

[45] Apr. 29, 1980

[54] MAGNETIC SPINNING TOP GAME

[76] Inventors: Roger W. Andrews; Melvin R. Andrews, both of Rte. 1, Box 303A3, Corvallis, Oreg. 97330

[21] Appl. No.: 871,360

[22] Filed: Jan. 23, 1978

[51] Int. Cl.[2] ..... A63H 1/00; A63H 33/26

[52] U.S. Cl. ..... 273/108; 46/235

[58] Field of Search ..... 273/108; 46/65, 234, 46/235

[56] References Cited

U.S. PATENT DOCUMENTS

| | | | |
|---|---|---|---|
| 433,599 | 8/1890 | Lockwood | 273/108 |
| 434,987 | 8/1890 | Hill | 273/108 |
| 459,997 | 9/1891 | Cromwell | 273/108 |
| 571,843 | 11/1896 | Pratt | 273/108 |
| 703,971 | 7/1902 | Schmid | 273/108 |
| 1,127,345 | 2/1915 | Zolper | 273/108 |
| 1,546,053 | 7/1925 | Wilkinson | 273/108 |
| 1,552,530 | 9/1925 | Woods | 273/108 |
| 2,433,995 | 1/1948 | Kevers | 46/235 |
| 3,783,550 | 1/1974 | Andrews | 46/45 |
| 3,815,911 | 6/1974 | Cooper | 273/108 |
| 4,113,254 | 9/1978 | Wolf | 273/108 |

FOREIGN PATENT DOCUMENTS

| | | | |
|---|---|---|---|
| 390026 | 2/1924 | Fed. Rep. of Germany | 273/108 |
| 1903285 | 7/1970 | Fed. Rep. of Germany | 273/108 |

*Primary Examiner*—Richard C. Pinkham
*Assistant Examiner*—Lawrence E. Anderson
*Attorney, Agent, or Firm*—Oliver D. Olson

[57] ABSTRACT

A spinning top game includes a spinner mounting a permanent magnet, a housing having a dished top base for supporting the spinner above an induction coil in the housing connected in an electric circuit including a source of electric potential and an electronic switch so arranged that when the spinner is rotated on the dished base, the moving magnetic field of the magnet cuts the coil turns and the resulting induced current operates the electronic switch intermittently to connect the source of electric potential across the coil, the resulting current flow through the coil producing a magnetic field which is imposed upon the moving magnet spinner such as to accelerate its movement. The dished base is provided with an upwardly convex central portion, a raised ridge spaced outwardly from the convex central portion and extending radially outward therefrom, and one or more hazards adjacent the outer periphery of the top for catching the spinner or otherwise preventing it from returning toward the center of the dished base and into the magnetic field of the coil.

9 Claims, 3 Drawing Figures

MAGNETIC SPINNING TOP GAME

BACKGROUND OF THE INVENTION

This invention relates to games, and more particularly to a novel electrically driven spinning top game.

U.S. Pat. No. 3,783,550 describes a novelty electric motor invention of the present applicant Roger W. Andrews. Although it is a very interesting and amusing conversation piece, its use as a game is limited primarily to an arrangement in which two or more spinners are put in motion on the same base so as to be caused to bump into each other on random occasions and under conditions such that one of the spinners may be toppled over or ejected from the base.

SUMMARY OF THE INVENTION

In its basic concept this invention utilizes the novelty electric motor of applicant's earlier U.S. Pat. No. 3,783,550 in association with a housing top base provided with hazards by which to prevent the return of a magnet spinner rotating thereon to an area of the base in which the spinner is subject to the intermittent magnetic field of an intermittently energized induction coil, by which the spinner receives its driving force.

It is by virtue of the foregoing basic concept that the principal objective of this invention is achieved; namely to modify the novelty electric motor described in applicant's earlier U.S. Pat. No. 3,783,550 to enable its use in a variety of ways as various games of chance and skill.

Another objective of this invention is the provision of a spinning top game of the class described which may utilize one or more spinners of various configurations in a wide variety of game plans.

Still another objective of this invention is the provision of a spinning top game of the class described in which a plurality of housings and associated electronic circuits may be joined together through their top bases to enable the movement of spinners from one top base to another.

The foregoing and other objects and advantages of this invention will appear from the following detailed description taken in connection with the accompanying drawing of preferred embodiments.

DESCRIPTION OF THE PREFERRED EMBODIMENTS

Figure 1:
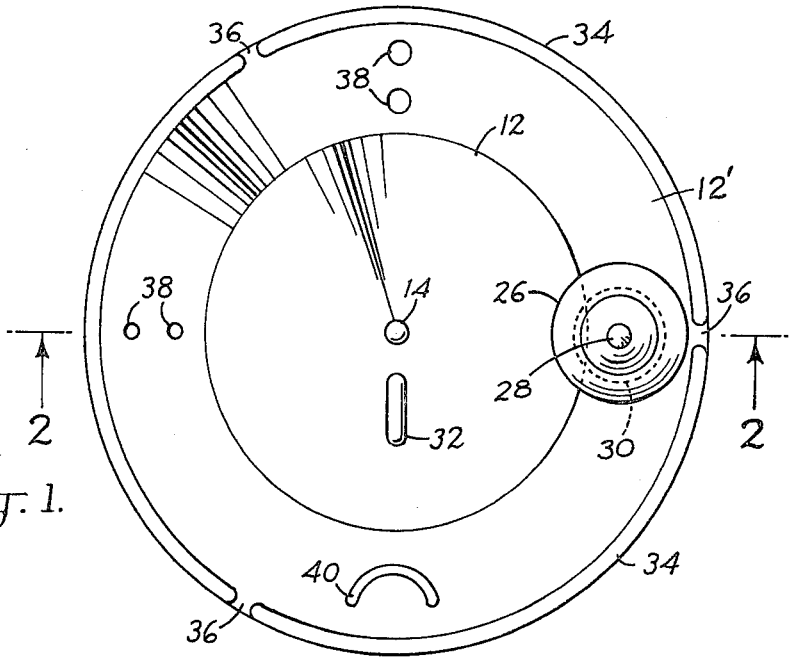
FIG. 1 is a plan view of a spinning top game embodying the features of this invention.
Figure 2:
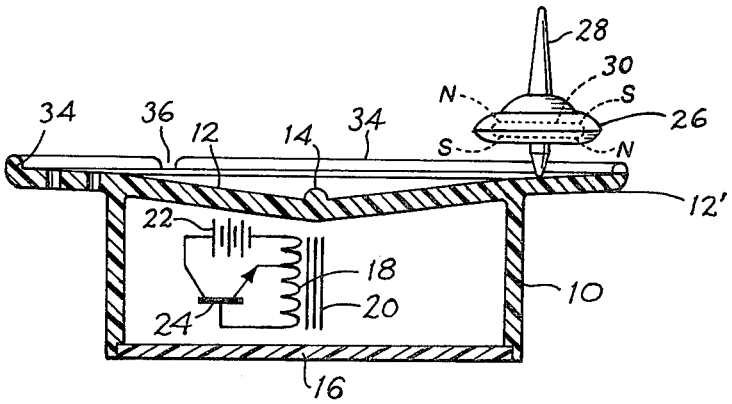
FIG. 2 is a transverse sectional view taken on the line 2—2 in FIG. 1.

Referring first to the embodiment illustrated in FIGS. 1 and 2 of the drawing, a hollow housing of non-magnetic material, such as wood or synthetic thermoplastic or thermosetting resin, includes a peripheral wall 10 and a dished top base 12 the upper surface of which is concave inwardly to a depressed center at which is located a raised central portion 14. The bottom, open side of the housing, is removably closed by a bottom wall 16.

Within the hollow housing there is mounted an induction coil 18 provided with an iron core 20 aligned with the central raised portion 14 of the base. The opposite ends of the coil are connected across a source 22 of direct current electric potential, for example one or more conventional dry cells, through a control switch. In the embodiment illustrated the control switch comprises a transistor 24 of the NPN type. The base of the transistor is connected to one end of the coil, the collector is connected to the positive terminal of the battery and the negative terminal of the battery is connected to the opposite end of the coil. The emitter is connected to an intermediate winding of the coil.

Associated with the foregoing electrical circuitry is a spinning top. As illustrated, the top has a circular body 26 and a pivot shaft 28 projecting through the central axis of the body. The body contains a permanent magnet 30 with the poles thereof disposed in a plane extending perpendicular to the rotational axis of the pivot shaft, as illustrated.

The foregoing components are disclosed in a detail in applicant's earlier U.S. Pat. No. 3,783,550 mentioned hereinbefore. In that disclosure, the spinning top functions as the armature of a motor, and the motor operates as follows: The portion of the pivot shaft 28 extending upwardly from the body of the magnet top is grasped between the thumb and index finger and, while being held over the dished top base, is spun from the fingers onto the base. By virtue of the concave contour of the base, the spinning top gravitates toward the central raised portion 14. The moving magnetic lines of force provided by the spinning magnet top cuts the turns of the coil 18 and thus induces a current in the coil. As is well known, the flow of current through the coil is reversed when the turns are cut by the lines of force associated with the opposite poles of the magnet. Thus, in one direction of current flow through the base-emitter of the transistor switch the transistor is turned on momentarily to connect the battery across the coil. Intermittent pulses of battery current thus are applied momentarily through the coil, whereupon the latter produces an intermittent magnetic field which is imposed upon the spinning magnet top in such manner to accelerate the spin of the top.

The magnetic field produced by the coil also influences other random motions of the spinning top, depending upon the location of the spinning top relative to the coil and to the positions of the magnet poles. Thus, the top may be flung outward of the central portion of the dished base to varying distances and at varying speeds and angles, or it may be pulled toward the center of the dished base. The spinning top also may be tilted slightly from vertical to varying degrees. The central raised portion 14 prevents the rotating spinner from staying at the center of the base.

The result of these variables is an amusing and interesting random skittering of the spinning top over the area of the base.

Each time the rotating magnetic field of the appropriate pole of the magnet cuts the coil turns, the spinning magnet top is accelerated. At all other times, as when the magnetic field of the opposite pole cuts the coil turns, the transistor remains cut off and no current flows in the electric circuit. When the spinning top is removed from the base, the battery supply is effectively open circuited and therefor is not wasted.

Accordingly, once the spinning top is put in motion upon the base it continues to rotate and move about the base in random fashion for as long as the battery supply lasts. In this regard it has been found that with a conventional 9 volt dry cell battery, the magnet top will continue spinning for about one week. On an intermittent use basis, as by normal use of the game, the battery will last more than six months.

It will be understood that acceleration of the spinning top continues until a state of equilibrium is reached at which frictional losses equal the energy input. Such losses are due in part by the friction of the air, in part to the area of contact between the spinning top and base, and in part to the extent to which the top is flung outward of the central portion of the base to areas of diminished magnetic field influence.

In accordance with this invention, the dished top base of the housing is provided with means by which to assist the magnetic field of the induction coil fling the spinning top radially outward from the central raised area 14 toward the outer periphery of the base. This is provided by a raised ridge 32 which is elongated in the radial direction of the base. Its inner end is spaced from the central raised area sufficiently to allow a spinning top to move through such spacing. The ridge need not be very long in the radial direction of the base, since its function is fulfilled when a spinning top circling the central area makes initial contact with the ridge. This contact with the ridge causes the spinning top to shoot outward with accelerated speed, as compared to the speed of outward movement induced simply by the intermittent repelling forces of the magnetic field.

Because of the foregoing increased acceleration of outward movement of the spinning top, the supporting base 12 may be extended radially outward from the outer periphery of the housing wall 10. In the preferred embodiment illustrated, the annular extension 12' of the base thus provided preferably is inclined toward the center 14 at a lesser angle than the central portion, in order to retain the spinning top in the outer periphery area for longer periods of time and thus extend the playing time of the game and enhance the interest thereof. Although the angles of inclination of these sections of the base may vary over a considerable range, it is preferred that the inner section of the base be inclined from horizontal about 5° and that the outer annular section 12' of the base be inclined from horizontal about 3°.

In the embodiment illustrated, the outer edge of the outer section of the base is provided with a raised peripheral rim 34 to prevent a spinning top from being ejected radially outward from the base. This annular retaining rim may be omitted if desired. For example, by omitting the retaining rim and holding the housing in the hand so that it may be tilted as necessary to prevent the spinning top from being ejected from the base, the game becomes one of skill.

In the embodiment illustrated, the peripheral retainer rim is interrupted at circumferentially spaced positions to provide passageways 36 through which a spinner may pass radially outward and off of the game playing surface of the base. This provides an element of chance associated with the game, as described hereinafter.

In addition to the passageways 36, the outer annular 12' of the base is provided with one or more other forms of hazards which operate to prevent return of the spinner to the central area of the base where it is influenced by the intermittent magnetic field. In the embodiment illustrated, such additional hazards are in the form of traps into which a spinner may be received and thus prevented from returning back toward the center of the base. Such traps thus also provide additional elements of chance associated with the playing of the game.

In the embodiment illustrated, one type of trap comprises a pocket 38 formed in the base. As illustrated, a plurality of such pockets are provided. They may be of different diameters, also as illustrated, and they may be positioned at various locations on the outer annular portion 12' of the base. They may extend completely through the outer section of the base, as illustrated, or only partially through the base, as desired. In any event, the spinner may enter one of the pockets and thus become trapped and incapable of returning to the central area of the base where it could be influenced by the intermittent magnetic field of the coil, for continued driving rotation. Accordingly, since the trapped spinner is no longer driven rotationally, it eventually stops rotating and topples over.

Another form of trap illustrated in the drawing comprises an arcuately shaped raised ridge 40 the concave inner surface of which faces the outer periphery of the base. The raised ridge thus forms a pocket the open side of which faces the outer periphery of the base. Thus, as the rotating spinner meanders about the base it may by chance enter the pocket. Since the outer section of the base slopes inwardly toward the center, the spinner is incapable of extricating itself from the pocket and eventually loses its rotational speed and topples over.

From the foregoing it will be apparent that the structural form of the game described hereinbefore may be utilized in a variety of ways to provide a correspondingly wide variety of games. For example, two or more spinners may be put in motion on a single base, with the objective that the winner would be the spinner that made the excursion to the outer periphery of the base and back to the center, once or any predetermined number of times. Such a game may also be played by utilizing a plurality of game units each including but a single spinner. The winner might be determined as the last spinner still rotating on the base, with the other spinners having become trapped in the pockets 38 or 40, or discharged from the base through one of the openings 36 in the peripheral rim.

Figure 3:
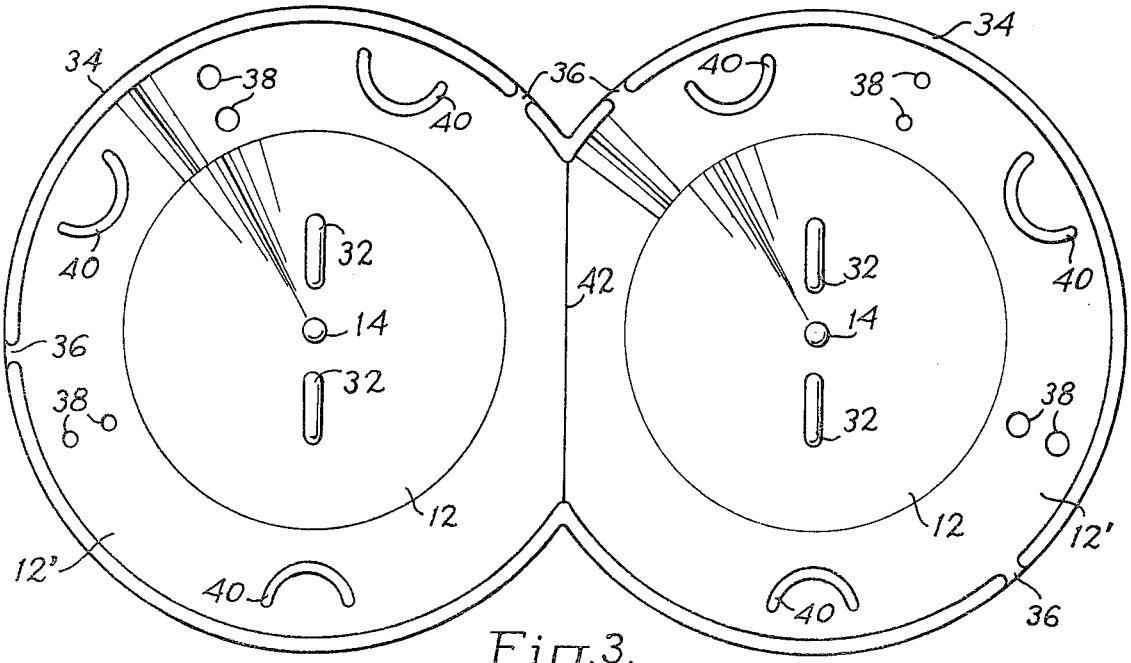
FIG. 3 is a plan view of a modified form of spinning top game embodying the features of this invention.

In the embodiment illustrated in FIG. 3, two of the units described hereinbefore and illustrated in FIGS. 1 and 2 are shown joined together along a straight line 42 defining a removed segment of the outer annular base section 12' of each unit. The assembly preferably is provided as a one piece, integral unit made by the molding of synthetic resin, as will be understood. Each of the dished top bases may include any desired number of accelerating ridges 32 and hazards 36, 38, 40.

In the embodiment of FIG. 3, spinners may be put in motion on either or both of the joined bases with the objective that they cross over to the other bases in the performance of a specified game. Alternatively, it may be a rule of the game that a player loses when his spinner moves onto his opponent's base.

From the foregoing, it will be appreciated that the game units described hereinbefore accommodate wide variations in rules and conditions of a wide variety of types of games.

It will also be apparent to those skilled in the art that various changes may be made in the size, shape, type, number and arrangement of components described hereinbefore. For example, the spinning top may take a variety of different shapes and designs, such as a spherical ball of non-magnetic material enclosing a permanent magnet of the type illustrated in FIG. 2. The dimensions of the escape openings 36 in the peripheral rim 34 and of the traps 38 and 40 may be made to accommodate such changes in shape and size of spinners. The double unit illustrated in FIG. 3 provides the suggestion that three or more of the single units may be joined together in manner analogous to the double unit, to provide a game unit for a still greater number of players or spinners. These and other changes may be made, as desired, without departing from the spirit of this invention.

Having now described our invention and the manner in which it may be used, we claim:

1. A spinning top game, comprising:
(a) a housing having a top spinner-supporting base which slopes inwardly to a depressed center,
(b) a magnet spinner arranged to be rotated upon the base,
(c) means in the housing for producing an intermittent magnetic field in the central area of the base for accelerating rotary movement of the spinner and for causing the spinner to move outward toward the periphery of the base, and
(d) at least one hazard on the base adjacent the outer, elevated periphery thereof for receiving a spinner and preventing it from returning toward the center of the base,
(e) the outer peripheral portion of the base containing the hazard sloping inwardly toward the depressed center at a lesser angle than the inner portion of the base.

2. The spinning top game of claim 1 wherein the hazard comprises a depressed pocket in the base.

3. The spinning top game of claim 1 wherein the hazard comprises a raised ridge on the base forming a pocket the open side of which faces the adjacent portion of the outer periphery of the base.

4. The spinning top game of claim 1 wherein the hazard comprises an upwardly extending peripheral rim on the base for preventing movement of a spinner outward off of the base, the peripheral rim being interrupted at at least one location to provide an opening through which a spinner may move outwardly off of the base.

5. The spinning top game of claim 1 including a raised projection at the depressed center of the base, and a raised ridge on the base spaced at its inner end slightly radially outward of said raised projection and extending radially outward toward the outer periphery of the base, whereby when a rotating spinner engages the ridge it is projected outward toward the periphery of the base.

6. The spinning top game of claim 1 wherein the means for producing the intermittent magnetic field comprises:
(a) an inductance coil having a magnetic metal core underlying and substantially aligned with the depressed center of the base, the coil having an electric circuit,
(b) a source of electric potential in the electric circuit of the coil, and
(c) means in the electric circuit of the coil operable by coil current induced by movement of the magnet spinner on the base for releasably connecting the source of electric potential across the coil momentarily to impose a magnetic field on the magnet spinner to accelerate movement thereof.

7. A spinning top game, comprising:
(a) a housing having a top spinner-supporting base which slopes inwardly to a depressed center, the slope of the inner portion of the base relative to horizontal being about 5° and the slope of the outer peripheral portion of the base relative to horizontal being about 3°,
(b) a magnet spinner arranged to be rotated upon the base,
(c) means in the housing for producing an intermittent magnetic field in the central area of the base for accelerating rotary movement of the spinner and for causing the spinner to move outward toward the periphery of the base, and
(d) at least one hazard on the outer peripheral portion of the base for receiving a spinner and preventing it from returning toward the center of the base.

8. A spinning top game, comprising:
(a) a housing having a top spinner-supporting base which slopes inwardly to a depressed center, the slope of the inner portion of the base relative to horizontal being about 5° and the slope of the outer peripheral portion of the base relative to horizontal being about 3°,
(b) a magnet spinner arranged to be rotated upon the base,
(c) means in the housing for producing an intermittent magnetic field in the central area of the base for accelerating rotary movement of the spinner and for causing the spinner to move outward toward the periphery of the base, the means for producing the intermittent magnetic field comprising an inductance coil having a magnetic metal core underlying and substantially aligned with the depressed center of the base, the coil having an electric circuit, a source of electric potential in the electric circuit of the coil, and means in the electric circuit of the coil operable by coil current induced by movement of the magnet spinner on the base for releasably connecting the source of electric potential across the coil momentarily to impose a magnetic field on the magnet spinner to accelerate the movement thereof, and
(d) a plurality of hazards on the outer peripheral portion of the base, one comprising an upwardly extending peripheral rim on the base for preventing movement of a spinner outward off of the base, the peripheral rim being interrupted at at least one location to provide an opening through which a spinner may move outwardly off of the base, and another of said hazards comprising a pocket on the outer peripheral portion of the base for receiving a spinner and preventing it from returning toward the center of the base.

9. The spinning top game of claim 1 wherein a plurality of said housings are interconnected at peripheral portions of their top bases for passage of a spinner between said plurality of bases, the remaining portions of the bases having an upwardly extending peripheral rim for preventing movement of a spinner outwardly off of the bases.

* * * * *